US012723482B2

(12) United States Patent
Fould et al.

(10) Patent No.: US 12,723,482 B2
(45) Date of Patent: Sep. 1, 2026

(54) COMPOSITE JOINT WITH CASING EXIT LOCATOR

(71) Applicant: Schlumberger Technology Corporation, Sugar Land, TX (US)

(72) Inventors: Jeremie Fould, Al Khobar (SA); Miguel Angel Tejada, Al Khobar (SA); Mahmoud Seiam, Al Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/116,393

(22) PCT Filed: Oct. 6, 2023

(86) PCT No.: PCT/US2023/034656
§ 371 (c)(1),
(2) Date: Mar. 28, 2025

(87) PCT Pub. No.: WO2024/076741
PCT Pub. Date: Apr. 11, 2024

(65) Prior Publication Data

US 2026/0098450 A1 Apr. 9, 2026

Related U.S. Application Data

(60) Provisional application No. 63/378,538, filed on Oct. 6, 2022.

(51) Int. Cl.

| | |
|---|---|
| ***E21B 29/06*** | (2006.01) |
| ***E21B 7/06*** | (2006.01) |
| ***E21B 23/01*** | (2006.01) |
| ***E21B 33/14*** | (2006.01) |

(52) U.S. Cl.
CPC ..... *E21B 29/06* (2013.01); *E21B 7/061* (2013.01); *E21B 23/01* (2013.01); *E21B 33/14* (2013.01)

(58) Field of Classification Search
CPC ..... E21B 29/06; E21B 7/061
See application file for complete search history.

(56) References Cited

U.S. PATENT DOCUMENTS 5,735,350 A 4/1998 Longbottom et al.
6,015,012 A 1/2000 Reddick
(Continued)

FOREIGN PATENT DOCUMENTS

WO 2015069269 A1 5/2015

OTHER PUBLICATIONS

International Search Report and Written Opinion of International Patent Application No. PCT/US2023/034656 dated on Feb. 1, 2024, 11 pages.

*Primary Examiner* — Kristyn A Hall
(74) *Attorney, Agent, or Firm* — Kyle R. Miiller

(57) ABSTRACT

An apparatus and method of creating a window in a composite casing section. The composite casing section has a metallic casing, an indexing locator and a composite joint. The composite joint is positioned between the metallic casing and indexing locator. The indexing locator is configured to locate a departure device within the wellbore. The departure device directs the milling device to mill the window through the composite joint. A lateral wellbore is created after the window is milled through the composite joint.

17 Claims, 5 Drawing Sheets

(56) References Cited

U.S. PATENT DOCUMENTS

| | | | | |
|---|---|---|---|---|
| 2002/0195249 | A1* | 12/2002 | Murray | E21B 7/06 166/50 |
| 2003/0196819 | A1* | 10/2003 | Coon | E21B 47/024 166/117.6 |
| 2004/0244992 | A1 | 12/2004 | Carter | |
| 2018/0266192 | A1 | 9/2018 | Gosney | |

* cited by examiner

COMPOSITE JOINT WITH CASING EXIT LOCATOR

CROSS-REFERENCE TO RELATED APPLICATION

This application is a National Stage and claims benefit of PCT Patent Application No.: PCT/US2023/034656, filed Oct. 6, 2023, which is based on and claims priority to U.S. Provisional Application Ser. No. 63/378,538, filed Oct. 6, 2022, which is incorporated herein by reference in its entirety.

BACKGROUND

Wellbores drilled through the Earth's subsurface may be oriented in various directions and as such, may be vertical, deviated or horizontal wellbores. A multilateral well may have a parent wellbore and one or more lateral wellbore branches, which extend from the parent wellbore into the surrounding formation. The parent wellbore may be cased by a casing string that lines and supports the parent wellbore. Liners may line and support the lateral wellbores that extend from the parent wellbore. The casing and possibly the liners may be cemented in place in the well.

The lateral wellbore of a multilateral well may be formed by running a drill string into the parent wellbore and extending the drill string through a milled section of casing called a "casing window" of the parent casing string and drilling the surrounding formation. Milling through a casing string causes metallic debris and creates excessive wear on a milling tool. There is a need for a casing section that does not create metallic debris from the casing or creates excessive wear on a milling tool while milling through casing.

SUMMARY

The present invention relates to milling a casing window for a lateral borehole with a composite casing section that does not require the composite casing section to be oriented before drilling the window in the composite casing section.

In some embodiments, a composite casing section for use with a departure device for directing a milling device and comprising an anchor. The composite casing section comprising a metallic casing, an indexing locator, and a composite joint. The indexing locator configured to locate the departure device within the wellbore and receive the anchor of the departure device. The composite joint couples the metallic casing and the indexing locator and the composite joint is positioned relative to the indexing locator such that the departure device directs the milling device to mill a window through the composite joint.

In some embodiments, a method comprising cementing a composite casing section within a wellbore and locating a departure device within the composite casing section. The method may also disclose anchoring the departure device to an indexing locator of the composite casing section and directing a milling device via the departure device to mill a window through a composite joint of the composite casing section.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

Figure 1:
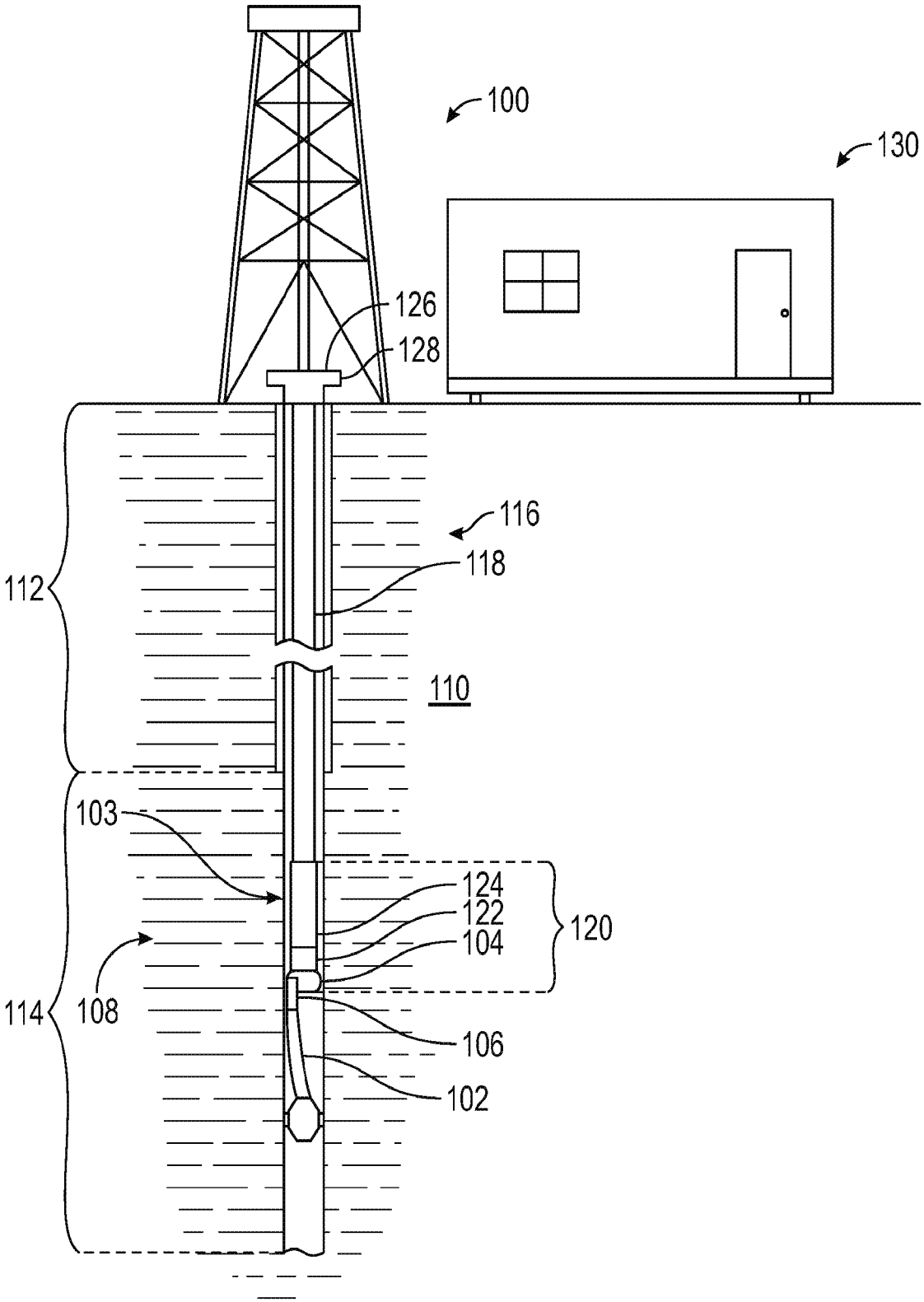
FIG. 1 illustrates a drilling system having a departure device coupled to a delivery mechanism.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

A wellbore may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. The formations through which the wellbore passes can be evaluated for a variety of properties, including the presence of hydrocarbon reservoirs in the formation, and the trajectory of the wellbore may be altered to optimize the location of the wellbore in the formation. In a process known as sidetracking, deviated or lateral boreholes may also be drilled to branch off from a wellbore in order to extend access to other areas of the formation. Wellbores and lateral boreholes may be drilled using a drill bit attached to the downhole end of a drill string.

When a lateral borehole is formed to branch off from a wellbore, a whipstock may be placed in the primary wellbore. The whipstock may include a ramped face used to direct a bit laterally away from the longitudinal axis of the wellbore. In a cased wellbore, a window may be milled through the casing in order to open the casing to the surrounding formation before drilling resumes to produce a lateral borehole. In an open hole wellbore, the bit may directly access the surrounding formation for a drilling operation used to produce the lateral wellbore.

FIG. 1 illustrates a drilling system 100 having a departure device 102 coupled to a delivery mechanism 103. The delivery mechanism 103 may include various components, including a bit 104. The bit 104 may be coupled to the departure device 102 by a connector 106, in accordance with one or more embodiments of the present disclosure. In some embodiments, the connector 106 may be a millable connector.

FIG. 1 also depicts a primary wellbore 108 extending into a formation 110. The term "primary wellbore," as used herein, refers to a wellbore or borehole from which a deviated or lateral borehole may begin. For example, a lateral borehole may be a sidetracked borehole that branches off of, or otherwise extends laterally from, the primary wellbore. The primary wellbore may itself be a wellbore extending to the surface or may be a branch off one or more other wellbores or boreholes. The term "lateral borehole" should be understood as describing a borehole extending at an angle from a longitudinal axis of the primary wellbore and should not limit the application of the technique or techniques described herein. For example, a lateral borehole may extend from a lateral surface of a primary wellbore. In other words, a lateral borehole may extend at a non-parallel angle from a lateral surface of a primary wellbore.

FIG. 1 depicts a primary wellbore 108 that may have an optional cased portion 112. The cased portion 112 may include casing or liner installed therein to reinforce the primary wellbore 108 against the fluid pressure of the formation 110, to isolate the wellbore 108 from fluids within the formation 110, or for myriad other purposes. The length and/or presence of the cased portion 112 may vary depending on the formation 110 through which the primary wellbore 108 is drilled, the function of the wellbore 108, and the like. In some embodiments, the primary wellbore 108 may include an uncased or "open hole" portion 114 in which no casing or liner lines the primary wellbore 108. The open hole portion 114 may extend through the formation 110 with little or no additional reinforcement. In some embodiments, the cased portion 112 may be less than entirely cased about the circumference of the cased portion 112. For example, a window or other feature may be formed by removing a section of the cased portion 112. In other embodiments, a full or significant length of the primary wellbore 108 may be cased. In still other embodiments, the open hole portion 114 may extend a full length of the primary wellbore 108.

The departure device 102 may be positioned in the primary wellbore 108 by using the delivery mechanism 103. The delivery mechanism 103 may include a drill string 116. The drill string 116 may include a tubular 118 and a bottomhole assembly (BHA) 120. The tubular 118 may include a number of components such as drill pipe, coiled tubing, drill collars, transition drill pipe (e.g., heavy weight drill pipe), or similar components. In some embodiments, the tubular 118 may transmit torque and/or longitudinal force through the primary wellbore 108 to the BHA 120. In the same or other embodiments, the tubular 118 may be used to transmit fluid to the BHA 120. Optionally, the BHA 120 may include a mud motor (e.g., turbine-powered motor, positive displacement motor, etc.) to convert fluid flow to a rotational force that may then rotate the bit 104 or other components of the BHA 120.

The BHA 120 may include the bit 104, which may be configured to remove material from the formation 110 to extend the primary wellbore 108 and/or to drill a lateral borehole extending from the primary wellbore 108. In a cased wellbore (or cased portion of the primary wellbore 108), the bit 104 may be a mill, such as a window mill or section mill, that may mill through casing material to create a window through which the lateral borehole may be drilled. In an open hole wellbore (or open hole portion of the primary wellbore 108), the bit 104 may be a drill bit that may drill through the formation 110 to form the lateral borehole. In some embodiments, the bit 104 may be used as a mill-drill bit for both milling casing (or components within a wellbore as discussed in more detail herein) and drilling formation. In some embodiments, a drill bit may be used for removing casing or other non-formation materials and/or a mill may be used in an open hole wellbore or to remove formation. In further embodiments, other bits may be used for one or both an open hole or a cased wellbore. In at least some embodiments, a connector 106 configured to couple the departure device 102 to the bit 104 or other component of the delivery mechanism 103 may allow the departure device 102 to be positioned (e.g., oriented and/or anchored) within the primary wellbore 108 and a lateral borehole to be fully or partially formed in a single trip.

According to some embodiments, the BHA 120 may include a directional mechanism used to guide or steer the BHA 120 and/or the bit 104. For instance, a directional mechanism may include a steerable portion 122 located on, near, or adjacent to the bit 104. In some embodiments, the steerable portion 122 may direct (i.e., guide) the bit 104. For example, the steerable portion 122 may direct the bit during any applicable stage of the wellbore departure process (e.g., drilling, milling, orienting and anchoring of the departure device, or combinations thereof). Example steerable portions 122 may include bent housings, point-the-bit, push-the-bit, or other directional mechanisms. Optionally, the steerable portion 122 may be used to obtain a bit path or trajectory which deviates from an existing wellbore or borehole, an inclined wellbore or borehole, a curved wellbore or borehole, or combinations of the foregoing. In at least some embodiments, the steerable portion 122 may be removed (e.g., the departure device 102 may direct the path of the bit 104 without additional steering).

The BHA 120 may include one or more sensors or data collection modules 124. The data collection modules 124 may collect information regarding the state of the fluid present in the formation 110, properties of the formation 110, the state of the drilling system 100, progress of a drilling process, other information, or combinations thereof. The data collection modules 124 may include measurement-while-drilling ("MWD") modules, logging-while-drilling ("LWD") modules, proximity sensors, pressure sensors, velocity sensors, visibility sensors, accelerometers, gyroscopes, temperature sensors, vibration sensors, other sensors, or a combination of the foregoing. The data collection modules 124 may be located on or within any component of the BHA 120, coupled to the BHA 120 as stand-alone or modular components (e.g., measurement subs), or otherwise coupled to the drill string 116.

In some embodiments, the drill string 116 may transmit torque from the surface. For instance, a kelly 126 mated to a rotary table 128 may have a kelly bushing (not shown) which may have an inside profile that may complementarily mate with an outside profile of the kelly 126, such as a square, hexagon, or other polygonal shape. Such mating may allow the kelly 126 to transmit torque to the drill string 116. Optionally, the kelly 126 may move longitudinally relative to the rotary table 128 in order to transmit longitudinal forces to the drill string 116. In other embodiments, the drill string 116 may be rotated by another torque transmitting device. For instance, a top drive (not shown) may be used. In still other embodiments, a downhole torque transmitting device (e.g., a mud motor, a turbine-powered motor, etc.) may be used. For instance, a downhole motor may be coupled to segmented drill pipe or coiled tubing, and may include a positive displacement motor, turbine, or the like to rotate a drive shaft coupled to a portion of the drill string 116 (e.g., bit 104).

The rotation and/or longitudinal movement of the drill string 116 may be controlled via a control system. The control system may receive information from surface and/or downhole sources. For example, the data collection modules 124 may send instructions or data which may be used to control the rotational speed of the drill string 116, the flow of fluid into the drill string 116 or wellbore 108, the weight on the bit 104, or the like. Where the data collection modules 124 provide information used to orient and/or anchor the departure device 102 or drill a lateral borehole, the information may be used in an open-loop or closed-loop control system. For instance, pre-programmed software, hardware, firmware, or the like may enable the data collection modules 124 to automatically steer the BHA 120, including the bit 104, when forming the lateral borehole. In other embodiments, however, the control system may be an open loop control system which may use surface controls, and potentially operator-assisted controls.

Information may be provided from the data collection modules 124 to a controller (e.g., at the surface or in the drill string 116 or BHA 120) or operator. The controller or operator may review or process data received from the data collection modules 124 and/or may provide instructions or control signals to the control system to direct drilling of the lateral borehole and/or orienting and anchoring of the departure device 102. The data collection modules 124 may include controllers positioned downhole and/or at the surface that may vary the operation of (e.g., steer or orient) the bit 104, the departure device 102 via the connector 106, or other portions of the BHA 120. Mud pulse telemetry, wired drill pipe, fiber optic coiled tubing, wireless signal propagation, radio-frequency identification (RFID) tags, other information transmission techniques, or combinations thereof may be used to send information to or from the surface.

As shown in FIG. 1, information collected regarding the position, orientation, or other status of the drill string 116, formation 110, departure device 102, or other portions of the drilling system 100 may be communicated to an operations center 130, depicted herein as a fixed operations center. In other embodiments, the operations center 130 may be a mobile operations center housed in a vehicle or a movable structure. The operations center 130 may be local or remote relative to the primary wellbore 108 and may include a computing system that may include or have access to a controller to receive and/or process data transmitted from the surface and/or BHA 120 (e.g., data from the data collection modules 124 and/or regarding the steerable portion 122, the bit 104, or the departure device 102). While the drilling system 100 depicted in FIG. 1 is a land-based drilling system, it should be understood that embodiments of the present disclosure are also applicable to other drilling systems, including offshore rigs.

Figure 2:
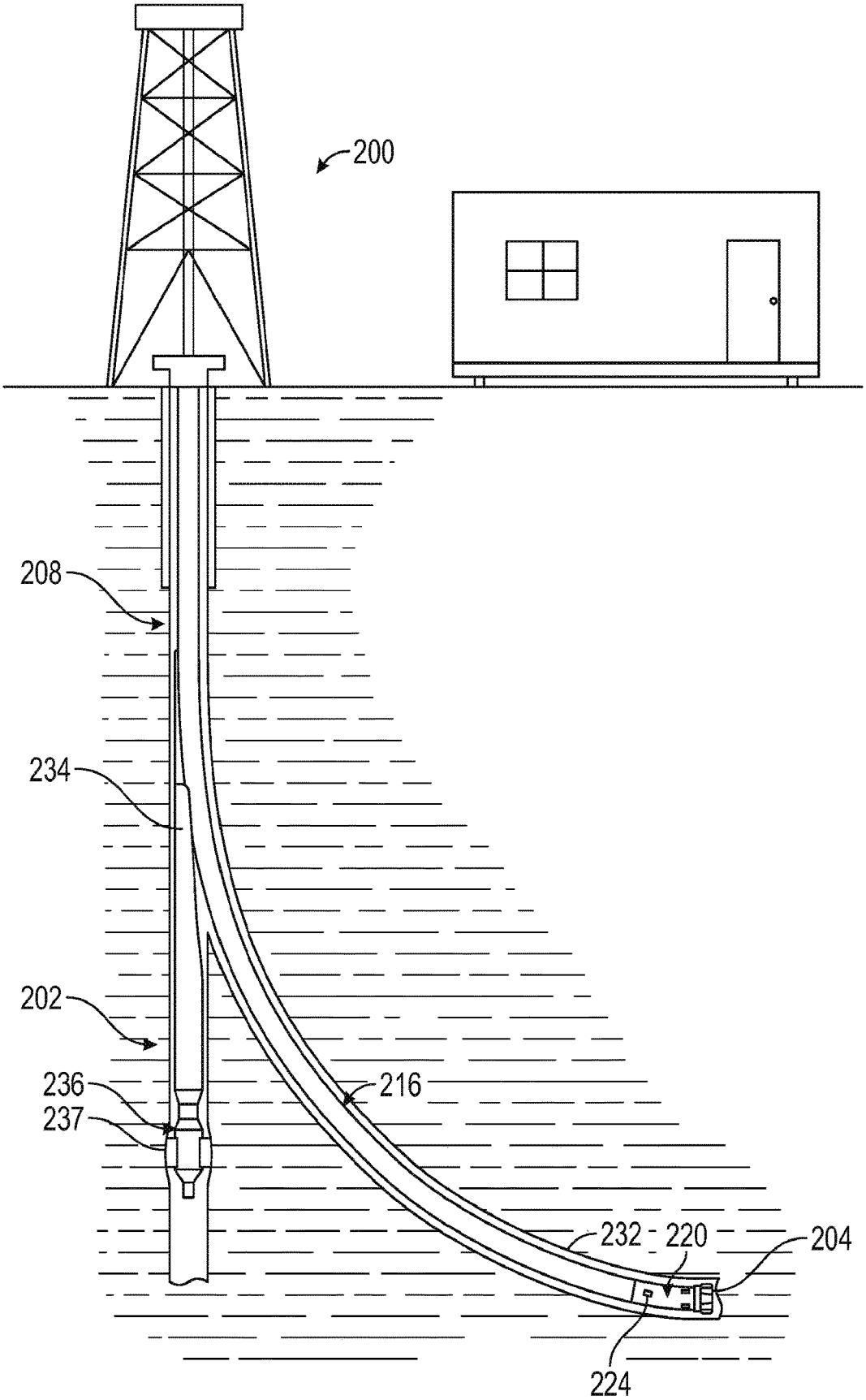
FIG. 2 illustrates the drilling system in which a lateral borehole is formed and departs from the primary wellbore with the assistance of the departure device.

FIG. 2 illustrates a drilling system 200 in which a lateral borehole 232 is formed and departs from a primary wellbore 208 with the assistance of a departure device 202. As discussed in more detail herein, formation of the lateral borehole 232 may occur after a BHA 220 (including bit 204) is released from a departure device 202, and optionally after fully or partially removing a connector which previously coupled the BHA 220 to the departure device 202. The departure device 202 may include a whipstock 234 coupled to an anchor 236 or other securing device. In at least some embodiments, the departure device 202 may have a connector that may allow the departure device 202 to connect to a bit 204, other component of a BHA 220, other delivery mechanism, or combinations thereof. The connector may facilitate the transmission of torque and/or longitudinal force applied to a drill string 216 (whether from a surface or downhole source) to the departure device 202. The departure device 202 may thereby be oriented to a desired azimuth (i.e., rotated) and/or moved (i.e., advanced and/or retracted) within the primary wellbore 208 to place the departure device 202 in a particular orientation in the primary wellbore 208. In some embodiments, the connector may be a millable connector configured to be milled or otherwise degraded by the bit 204 after the departure device 202 is separated from the BHA 220.

The orientation of the departure device 202 in the primary wellbore 208 may at least partially determine the orientation of the lateral borehole 232. The lateral borehole 232 may be drilled and/or the departure device 202 may be placed by a similar (or the same) drill string 216 as that used to drill the primary wellbore 208. In other embodiments, the drill string 216 coupled to the departure device 202 may be different than the drill string used to drill the primary wellbore 208. After positioning the departure device 202 in the primary wellbore 208, the anchor 236 may be activated to secure the departure device 202 in place within the primary wellbore 208. Activation of the anchor 236 may include, in some embodiments, moving expandable members 237 radially outward, expanding a sealing element, or other techniques which engage the internal wall of the primary wellbore 208 (or casing in a cased wellbore) to secure the anchor 236 at a particular orientation and/or axial position in the primary wellbore 208. In at least some embodiments, activating the anchor 236 to secure the departure device 202 in place may facilitate separation of the departure device 202 from the drill string 216. Data may be acquired by the BHA 220 (e.g., acquired by data collection modules 224), and may relate to the state of the system (e.g., drilling progress, position in a wellbore, formation properties, fluid properties, position of a steering system, orientation, etc.), and may be stored downhole, transmitted to the surface, or otherwise handled.

Figure 3:
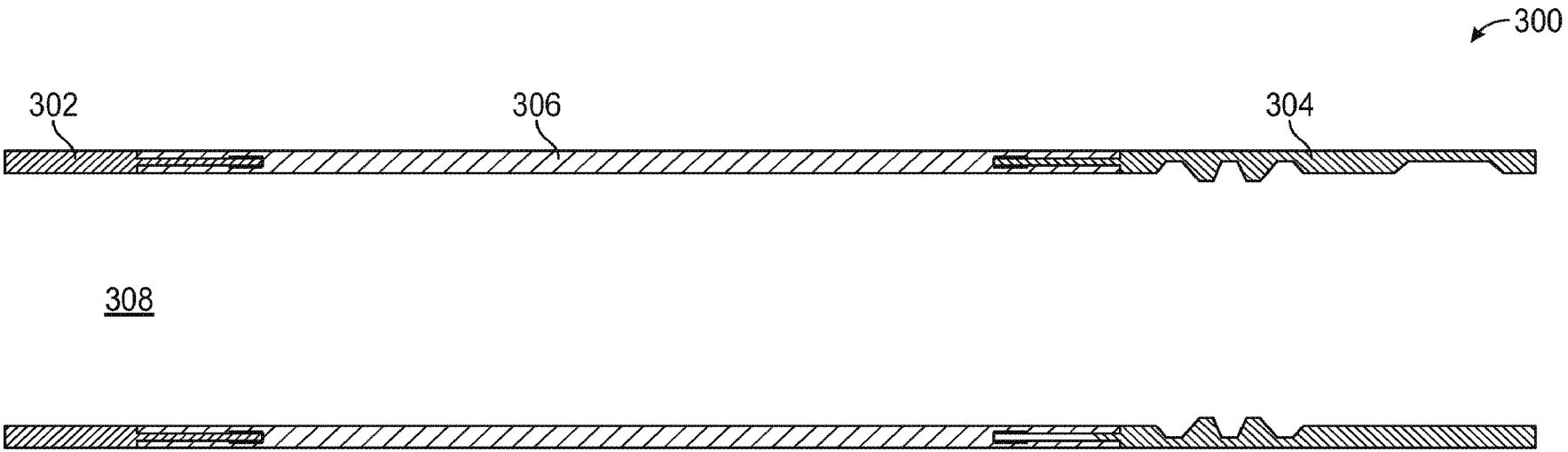
FIG. 3 is a cross-sectional diagram of a composite casing section.

Turning now to FIG. 3, FIG. 3 is a cross-sectional view of a composite casing section 300 usable within a primary borehole, such as the primary borehole 208 described above with reference to FIG. 2. The composite casing section 300 includes a metallic casing 302 and a metallic indexing locator 304 coupled via a composite joint 306. The composite joint 306 has a longitudinal bore 308 through which fluid or a downhole tool is conveyed through. The indexing locator 304 includes a profile that receives an anchor of a departure device, as shown in FIG. 4, to secure the departure device within the casing. The profile of the indexing locator 304 can be compatible with various whipstock systems with corresponding profiles.

The composite joint 306, i.e., a tubular section made from a composite material. The composite material may be, but not limited to, carbon fiber, fiberglass, or combinations thereof, or the like. The composite material is a softer material than steel or steel alloy and is easier to mill than steel or steel alloy. The composite joint 306 is tubular and a window can be milled in any location on the composite joint 306. The tubular shaped composite joint 306 ensures the casing does not need to be oriented when conveying the composite casing section 300 in a wellbore.

Figure 4C:
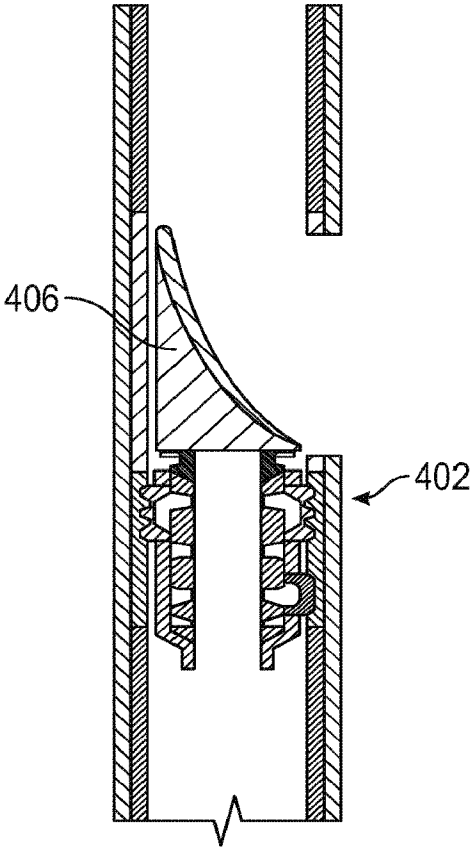
FIG. 4C illustrates a whipstock landed on the indexing locator in the composite casing section and a window created in the composite casing section.
Figure 4B:
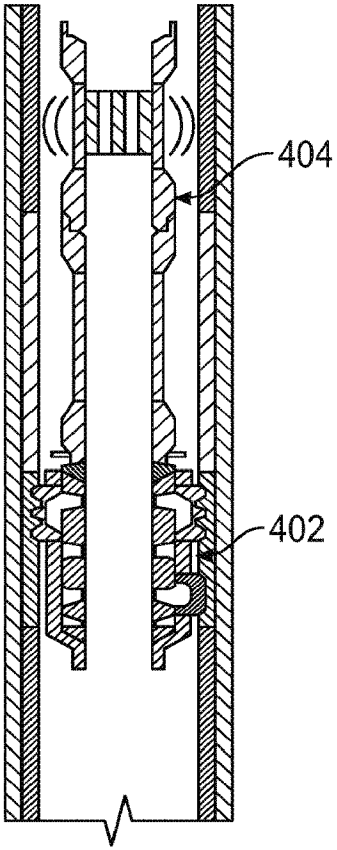
FIG. 4B illustrates the composite casing section with an indexing locator landed in the composite casing section.
Figure 4A:
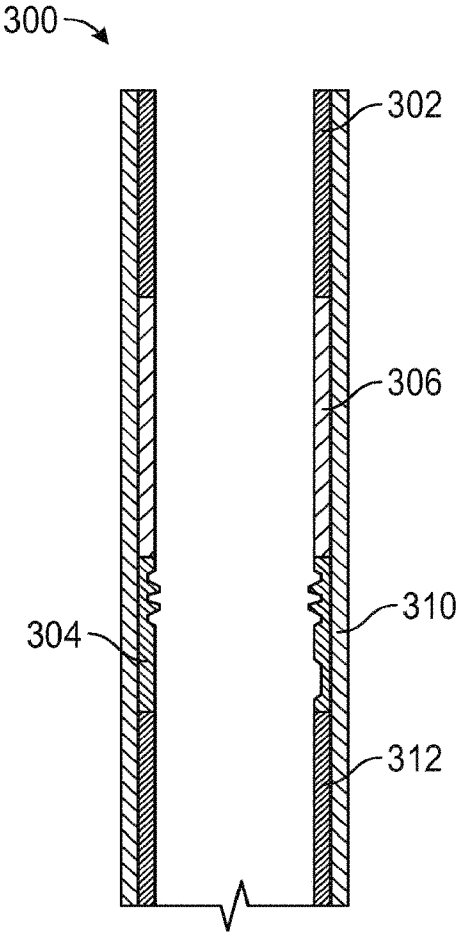
FIG. 4A illustrates the composite casing section in a cased and a cemented well.
Figure 4E:
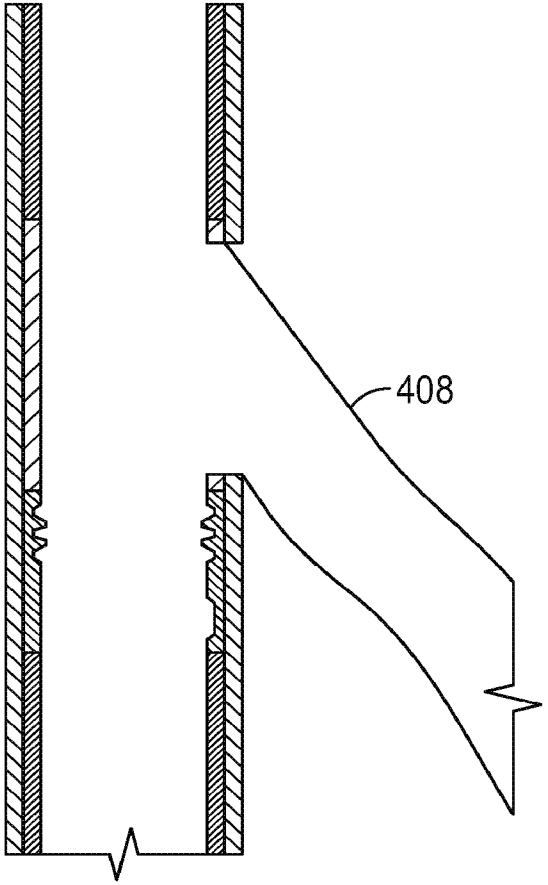
FIG. 4E illustrates the primary wellbore and lateral borehole after the whipstock and indexing locator has been removed.

In operation, as shown in FIG. 4A, a composite casing section 300 connected to a lower casing 312 positioned within a wellbore 310. The wellbore may be cemented. The composite casing section 300 has the metallic casing 302, the metallic indexing locator 304 coupled via a composite joint 306. The indexing locator 304 is positioned such that a departure device 402 can be positioned downhole.

As shown in FIG. 4B, the departure device 402 is connected to a measuring tool 404. The measuring tool 404 may measures downhole parameters. The departure device 402 and measuring tool 404 are conveyed downhole and positioned in the composite casing section 300. The anchor of the departure device is coupled to the indexing locator 304, as shown in FIG. 4B. The measuring tool 404 is released after the departure device 402 is set in the indexing locator 304.

Figure 4D:
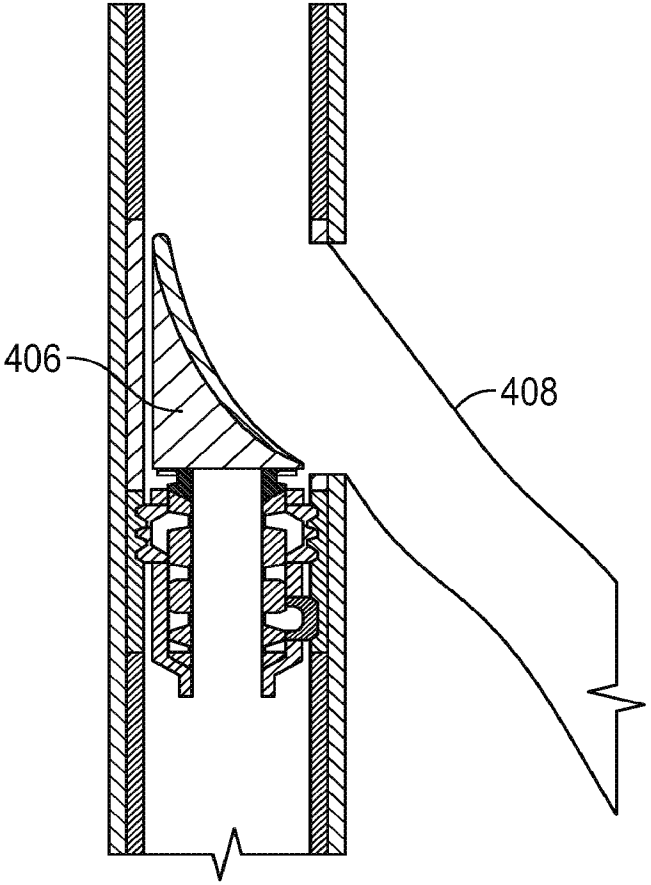
FIG. 4D illustrates a lateral borehole drilled through the window created in the composite casing section.

FIG. 4C illustrates a whipstock 406 that has landed on the departure device 402. The whipstock 406 directs a milling device to mill a window in the composite joint 306, as illustrated in FIG. 4C. The whipstock 406 allows a lateral wellbore 408 to be drilled in the desired direction, as illustrated in FIG. 4D. In another embodiment, the whipstock 406 and departure device can be conveyed together to land in the indexing locator. Once the lateral wellbore 408 is drilled the whipstock 406 and departure device 402 can be removed from the wellbore 310.

Milling the composite joint coupling 306 reduces the time required to mill the window when compared to milling a window in metallic casing. Further, the casing does not need to be oriented when it is installed. Milling the composite joint coupling 306 does not create metallic debris within the wellbore.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A composite casing section for use with a departure device for directing a milling device and comprising an anchor, the composite casing section comprising:

a metallic casing;

an indexing locator configured to locate the departure device within a wellbore and receive the anchor of the departure device, wherein the indexing locator comprises an inner profile engageable by radially expandable members of the anchor, and the inner profile has radial grooves disposed at least on radially opposite sides of a central axis; and a composite joint coupling the metallic casing and the indexing locator, wherein the composite joint is tubular and comprises a composite material extending about an entire circumference around the central axis, wherein the composite joint is positioned relative to the indexing locator such that the departure device directs the milling device to mill a window through the composite joint, wherein a first axial end portion of the composite joint has the composite material axially overlapping with the metallic casing about both inner and outer circumferences of the metallic casing, and wherein a second axial end portion of the composite joint has the composite material axially overlapping with the indexing locator about both inner and outer circumferences of the indexing locator.

2. The composite casing section of claim 1, wherein the composite material of the composite joint is a softer material than steel or steel alloy.

3. The composite casing section of claim 1, wherein the composite material of the composite joint comprises carbon fiber, fiberglass, or any combination thereof.

4. The composite casing section of claim 1, wherein a lateral wellbore is created after the window is milled through the composite joint.

5. The composite casing section of claim 1, wherein the composite material extending about the entire circumference around the central axis is configured to enable milling of the window in any angular position around the central axis without orienting the composite casing section within the wellbore.

6. A system to mill a window in a composite casing section disposed in a wellbore;

wherein the composite casing section is connected to a casing;

wherein the composite casing section comprises:

a metallic casing;

an indexing locator configured to locate a departure device within the wellbore and receive an anchor of the departure device, wherein the indexing locator comprises an inner profile engageable by radially expandable members of the anchor, and the inner profile has radial grooves disposed at least on radially opposite sides of a central axis; and a composite joint coupling the metallic casing and the indexing locator, wherein the composite joint is tubular and comprises a composite material extending about an entire circumference around the central axis, wherein the composite joint is positioned relative to the indexing locator such that the departure device directs a milling device to mill the window through the composite joint, wherein a first axial end portion of the composite joint has the composite material axially overlapping with the metallic casing about both inner and outer circumferences of the metallic casing, and wherein a second axial end portion of the composite joint has the composite material axially overlapping with the indexing locator about both inner and outer circumferences of the indexing locator.

7. The system of claim 6, wherein the composite material of the composite joint is a softer material than steel or steel alloy.

8. The system of claim 6, wherein the composite material of the composite joint comprises carbon fiber, fiberglass, or any combination thereof.

9. The system of claim 6, wherein a lateral wellbore is created after the window is milled through the composite joint.

10. A method of creating a window in a composite casing section comprising:

cementing the composite casing section within a wellbore;

locating a departure device within the composite casing section;

anchoring the departure device to an indexing locator of the composite casing section via an anchor, wherein the indexing locator comprises an inner profile engageable by radially expandable members of the anchor, and the inner profile has radial grooves disposed at least on radially opposite sides of a central axis; and directing a milling device via the departure device to mill the window through a composite joint of the composite casing section, wherein the composite joint is tubular and comprises a composite material extending about an entire circumference around the central axis, wherein a first axial end portion of the composite joint has the composite material axially overlapping with a metallic casing about both inner and outer circumferences of the metallic casing, and wherein a second axial end portion of the composite joint has the composite material axially overlapping with the indexing locator about both inner and outer circumferences of the indexing locator.

11. The method of claim 10, wherein a whipstock is landed on the departure device.

12. The method of claim 11, wherein the whipstock directs the milling device to mill the window in the composite joint.

13. The method of claim 10, wherein a lateral wellbore is created after the window is milled through the composite joint.

14. The method of claim 13, wherein the departure device is removed after the lateral wellbore is created.

15. The method of claim 10, wherein the composite material of the composite joint is a softer material than steel or steel alloy.

16. The method of claim 10, wherein the composite material of the composite joint comprises carbon fiber, fiberglass, or any combination thereof.

17. The method of claim 10, wherein the composite material extending about the entire circumference around the central axis is configured to enable milling of the window in any angular position around the central axis without orienting the composite casing section within the wellbore.

* * * * *